US006886481B1

(12) United States Patent
Lord

(10) Patent No.: US 6,886,481 B1
(45) Date of Patent: May 3, 2005

(54) PIVOTABLE BULB MOUNTED FOIL FOR SAILBOATS

(76) Inventor: Douglas W. Lord, 710 Wavecrest Dr., Orlando, FL (US) 32807

( * ) Notice: Subject to any disclaimer, the term of this patent is extended or adjusted under 35 U.S.C. 154(b) by 0 days.

(21) Appl. No.: 10/792,505

(22) Filed: Mar. 3, 2004

(51) Int. Cl.[7] ..... B63B 3/38
(52) U.S. Cl. ..... 114/39.24; 114/140
(58) Field of Search ..... 114/39.21, 39.24, 114/140, 274

(56) References Cited

U.S. PATENT DOCUMENTS

| | | | | |
|---|---|---|---|---|
| 768,085 | A | | 8/1904 | Stromborg |
| 3,080,845 | A | | 3/1963 | Pollak |
| 3,324,815 | A | | 6/1967 | Morales |
| 4,074,646 | A | | 2/1978 | Dorfman et al. |
| 4,686,922 | A | | 8/1987 | Burroughs |
| 4,686,923 | A | | 8/1987 | Greene |
| 5,152,238 | A | | 10/1992 | Page |
| 5,448,963 | A | * | 9/1995 | Gallington ..... 114/274 |
| 5,967,074 | A | | 10/1999 | Frantl et al. |
| 6,019,059 | A | | 2/2000 | Kelsey |
| 6,349,659 | B1 | * | 2/2002 | Hood ..... 114/39.21 |
| 6,397,771 | B1 | | 6/2002 | Levi et al. |
| 6,453,836 | B1 | | 9/2002 | Ditmore |

* cited by examiner

*Primary Examiner*—Stephen Avila
(74) *Attorney, Agent, or Firm*—William M. Hobby, III

(57) ABSTRACT

A pivotable deployable bulb mounted foil apparatus for a sailboat can pivot a foil mounted within a keel bulb remotely as needed to provide lateral resistance for the sailboat. The foil or foils can be rotated between a nested position for greater speed when the foils are not needed for lateral resistance in the water to an extended or operative position when needed for lateral resistance. The pivotal bulb mounted foil is especially adapted for use with a canting keel where the sailboat loses its lateral resistance from the keel when the keel is canted.

11 Claims, 5 Drawing Sheets

PIVOTABLE BULB MOUNTED FOIL FOR SAILBOATS

BACKGROUND OF THE INVENTION

The present invention relates to a sailing yacht and especially to a pivotally deployable bulb mounted foil for the keel of a sailing yacht which can pivot a foil mounted within a keel bulb remotely as needed to provide lateral resistance for the sailboat.

The use of canting keels on sailing yachts is being widely used around the world because by using hydraulics to "cant" a keel to weather, a boat can develop large extra amounts of righting moment and therefore power to carry sail which translates directly to speed.

If a canting keel is used however, some means must be found to augment the area required by a sailboat for lateral resistance since, as the keel cants, it presents less surface area capable of generating resistance to leeway. Several techniques have been employed to compensate for the loss of lateral resistance. It has been suggested to use twin fore and aft rudders to develop all lateral resistance, reducing the keel to just a ballast holding strut, or twin asymmetrical daggerboards that do the same thing. A single gybing daggerboard has been suggested as has been a system using fixed "wings" attached to the ballast bulb and extending out 90 degrees to the centerline of the boat so that as the keel cants, the fixed foils generate more and more lateral resistance replacing that lost by the keel.

The present invention mounts a pivotable asymmetric (flat on top) foil to the bulb that has been designed specifically to mate with it so that when the foil is not in use, it s pivoted so that its span is in line with the ballast bulb and actually forms a part of the bulb. When deployed, the foil is rotated 90 degrees so that it sticks out 90 degrees to the keel of the boat and the bulb. As the boat heels or the keel cants or both, this foil begins to develop lateral resistance lost to a canting keel or to a "normal" fixed keel when heeled. Then, when lateral resistance is no longer needed, the foil is rotated back to its nesting position, in line with the bulb, and forming the bottom of the bulb. This in effect eliminates the wetted surface and drag of the deployed foil or the fixed foils as in 4 above. Use of this system eliminates the need for twin fore and aft rudders or daggerboards when using a canting keel on a modern sailboat.

The present invention can also be retrofitted to existing yachts to improve windward performance with no wetted surface gain when not in use. It can-be designed into fixed keel sailboats so that the keel area can be reduced using the foil to augment windward performance while allowing improved downwind performance over a standard fixed keel due to the reduction of fin area made possible by the foil.

Control of the foil may be a number of ways such as by use of a shaft that runs through a fixed or canting keel and is adjustable by using a hydraulic motor mounted in the bulb or hydraulic or electric power to turn the shaft attached to the foil. The load on the foil as it is deployed will be light allowing use of minimal power and allowing a design feature to include a clutch such that if the lower (or upper) portion of the foil contacts anything, it would simply pivot.

Prior U.S. Patents for sailboat keel systems include the Burroughs U.S. Pat. No. 4,686,922 which has a pendulum like wing that might develop extra righting moment, at a cost of greater drag, and the Ditmore U.S. Pat. No. 6,453,836 for a foil that rotates about an axis parallel to the centerline of the sailboat. It generates extra lift when angled any number of ways relative to the fixed keel it is mounted to. This system is limited to use on a fixed keel. This system has a constant wetted surface and the system is not retractable. It may be stored behind the keel but it still causes wetted surface drag.

The Dorfman et al. U.S. Pat. No. 4,074,646 shows a method of changing the camber of a keel fin in order to help reduce leeway by making the keel more effective in developing lateral resistance. The Frantl et al. U.S. Pat. No. 5,967,074 allows multiple canting keels whose proximity to each other may cause increased drag. The system allows various combinations of lateral resistance at the cost of increased drag.

The Greene U.S. Pat. No. 4,686,923 is essentially a larger version of the trim tab used on many sailboats with winged keels. The Kelsey U.S. Pat. No. 6,019,059 is a foil that may be pivoted with the primary objective being to develop a combination of lateral resistance and/or lift but allows no decrease in wetted surface when not in use and requires a fixed, vertical fin to be mounted.

The Levi et al. U.S. Pat. No. 6,397,771 is for a method of utilizing a wing-like hydrofoil on a fixed keel such that the fixed keel or centerboard can be retracted to reduce the draft of the boat or to change the fore and aft sailing balance of the boat. While the horizontal foil stays immersed at all times, the vertical keel/centerboard may be partially retracted within the boat hull. The E. L. Morales U.S. Pat. No. 3,324,815 is a high drag device compared to modern foils/hydrofoils.

The Page U.S. Pat. No. 5,152,238 is a split canting keel with a fixed wing attached to either side of the split canting keel which will reduce draft but with increased drag. The E. G. Pollak U.S. Pat. No. 3,080,845 is a flap-like device attached to the back side of a conventional fixed keel and requires mounting on a fixed keel. The F. O. Stromborg U.S. Pat. No. 768,085 is a relatively low aspect ratio keel that can allow some small increase of windward performance offset by an increase in drag associated with the low aspect "blades".

SUMMARY OF THE INVENTION

A sailing boat apparatus has a boat hull having a keel having two sides and extending from the bottom of the hull. The keel has an elongated ballast bulb thereon. A rotatable foil is attached to the keel bulb and forms an integral part of the bulb when in a nested position and is rotatable about a generally perpendicular axis to the keel to extend the foil on both sides of the keel into an open operative position. A control member, which may be either a control shaft or cables or the like, extends through a channel in the hull and keel and is operatively attached to the foil to rotate the foil from a nested position, forming part of the bulb, to the operative position to provide lateral resistance in the water. The sailboat keel bulb has an extendible foil which maintains low resistance in the water when the foil is nested into the bulb and provides lateral resistance for the hull in the water when the foil is extended into an operative extended position. The foil may form the bottom of the keel bulb or, alternatively, may be an elongated section fitting into a center slot in the keel bulb. The keel may be a canting keel which is canted to either side and which can simultaneously extend the foil as desired. The shaft or cables rotating the foil can be hydraulically rotated against a spring bias while the keel may be pinned for rotation on a pin. Each of a pair of foils can be extended to opposite sides of the keel bulb.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
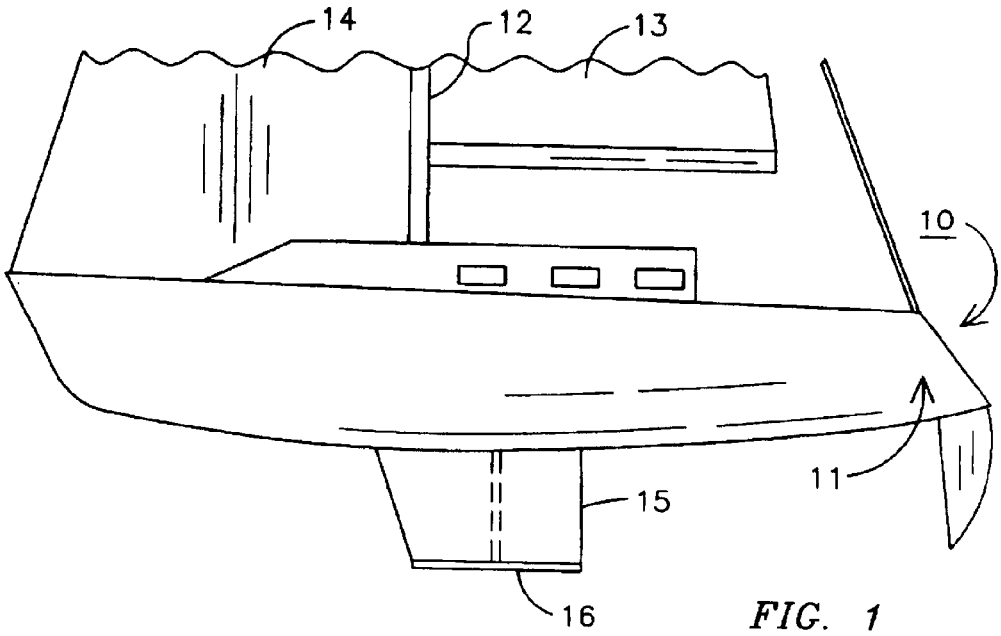
FIG. 1 is a partial side elevation of a sailboat having a keel having a rotating foil on the bottom thereof.
Figure 2:
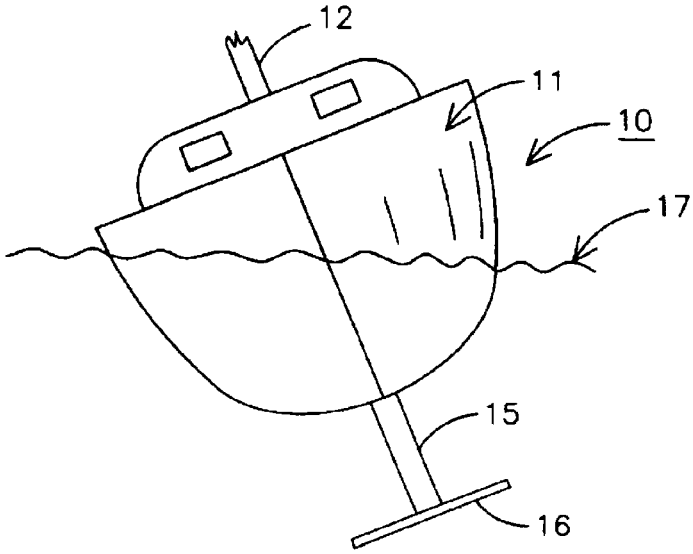
FIG. 2 is a partial front elevation of the sailboat of FIG. 1 in a tilted position.

Referring to the drawings and especially to FIGS. 1 and 2, a sailboat 10 is illustrated having a hull 11 and a mast 12 supporting a sail 13 and 14. The sailboat 10 hull 11 has a keel 15 protruding from the bottom thereof which is illustrated having a rotating foil 16 extending from the bottom. FIG. 2 illustrates the sailboat 10 in water 17 listing to one side and shows how the foil 16 when in an operative position provides lateral resistance to the hull. FIGS. 1 and 2 illustrate how an existing sailboat can be modified to incorporate the present invention.

Figure 3:
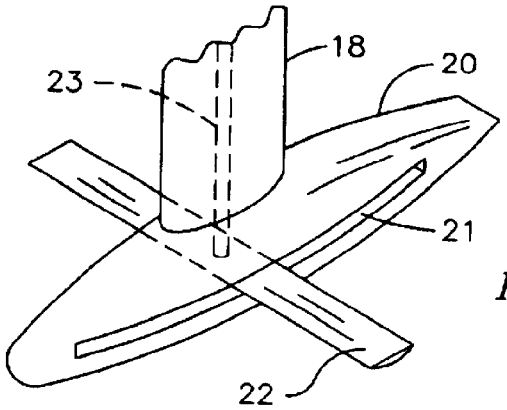
FIG. 3 is a partial perspective of a keel bulb foil in accordance with the present invention.
Figure 4:
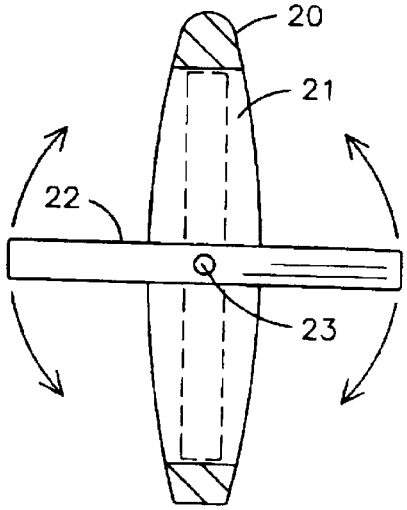
FIG. 4 is a sectional view taken through the keel bulb of FIG. 3.

Turning to FIGS. 3 and 4, a keel 18 is illustrated having a bulb 20 attached to the bottom thereof. The bulb 20 has an elongated cutout 21 having a foil 22 mounted therein. A shaft 23 is seen extending through the keel 18 and into the bulb 20 and being attached to the foil 22. The shaft 23 extends through the hull of the sailboat where it can be rotated to move the foil 22 into and out of position within the slotted area 21. The foil 22 is in a nesting position when fully inserted into the bulb 20 and in an operative or extended position, as shown in FIG. 3. The rotatable foil 22 advantageously will reduce resistance on the bulb when the foil is nested and will provide lateral resistance for the hull in water when extended, as shown in FIGS. 3 and 4 and as illustrated in FIG. 2.

Figure 5:
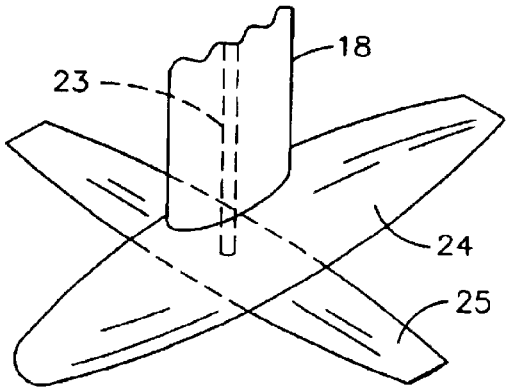
FIG. 5 is a perspective view of a keel bulb having another embodiment of the foil of the present invention.
Figure 6:
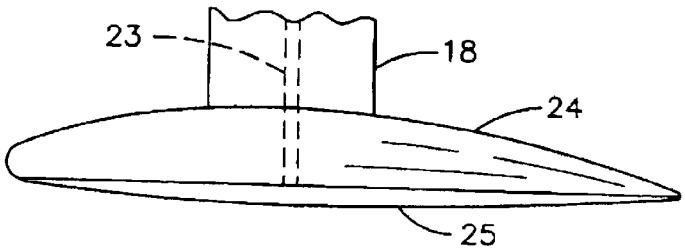
FIG. 6 is a side elevation view of the keel bulb of FIG. 5 with the foil in a nested position.

Turning to FIGS. 5 and 6, a second embodiment of the pivotal foil, keel and bulb is illustrated having the keel 18 having the shaft 20 extending therethrough and into a bulb 24. A pivotal foil 25 can be seen in an extended or operative position in FIG. 5 and in a nested position in FIG. 6. In FIG. 6, the foil 25 becomes part of the bulb when in a nested position to reduce resistance to the foil passing through water and can be rotated by virtue of the shaft 23 to an operative position, as in FIG. 5, to provide the lateral resistance to the sailboat.

Figure 7:
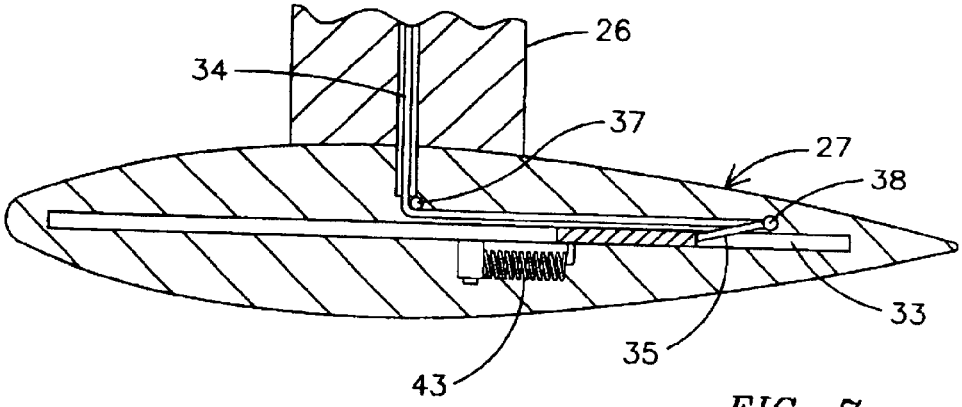
FIG. 7 is a sectional view of yet another embodiment having a pair of foils extending out each side of the keel bulb.
Figure 8:
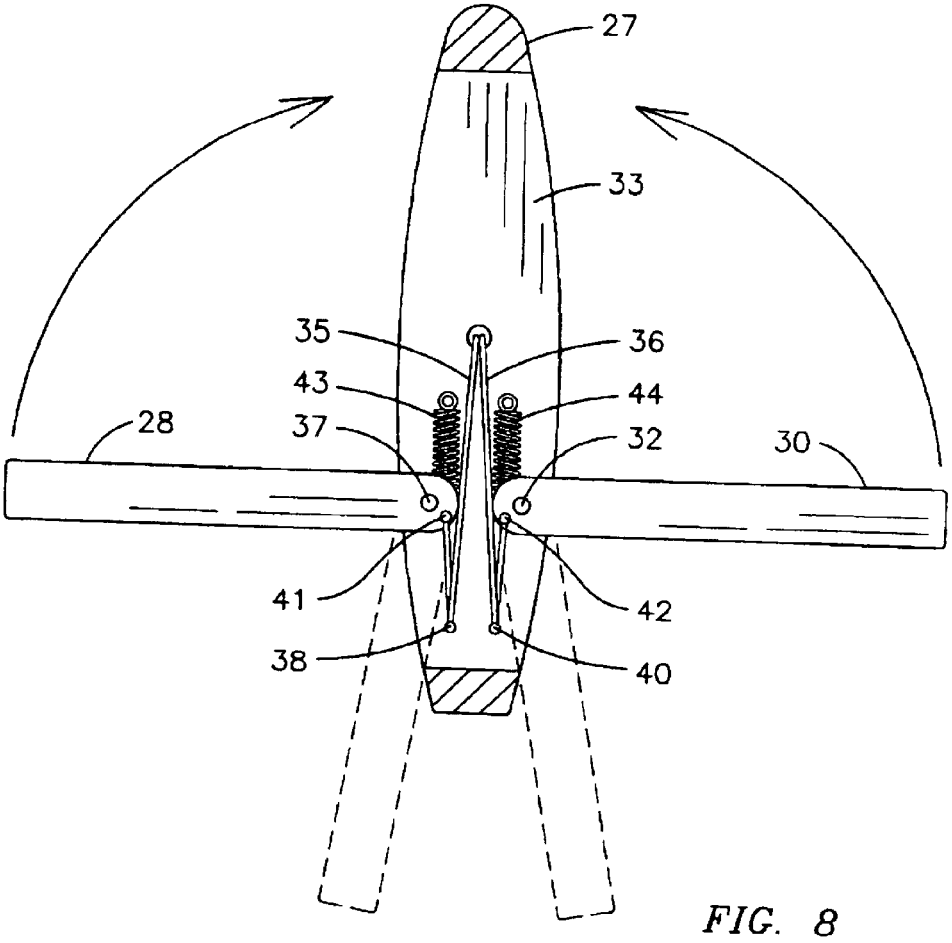
FIG. 8 is a sectional view of the keel bulb having two oils in accordance with claim 7.

FIGS. 7 and 8 illustrate yet another embodiment of a pivotally deployable bulb mounted foil having a keel 26 having a bulb 27 attached thereto and having a pair of pivotal foils 28 and 30. Foil 28 is pinned with a pin 31 while foil 30 is pinned with a pin 32 to the bulb 27 allowing the foils 28 and 30 to slide within the open slot 33 in the bulb 27 when in a nested position and to swing into an operative position, as seen in FIG. 8. A channel 34 can be seen extending through the keel 26 and into the bulb 27. A pair of cables 35 and 36 are seen extending through the channel 34 and extending around a pulley 37. The cable 35 then extends around a pulley 38 while the cable 35 extends around a pulley 40. The cable 35 is then attached at 41 to the foil 28 while cable 36 is anchored at 42 to the foil 30. A biasing spring 43 is also attached to the foil 28 while biasing spring 44 is attached to the foil 30 and can maintain the foils 28 and 30 into a nested position, if desired, until such time as the cables 35 and 36 are pulled from inside the hull of the boat to pull the foils 28 and 30 into an operative extended position, as shown in FIG. 8. Thus, in each instance, the foils are held in a nested position for reducing friction on the keel bulb and can be pivoted into an operative position from within the hull when needed to provide lateral resistance to the hull in the water.

Figure 9:
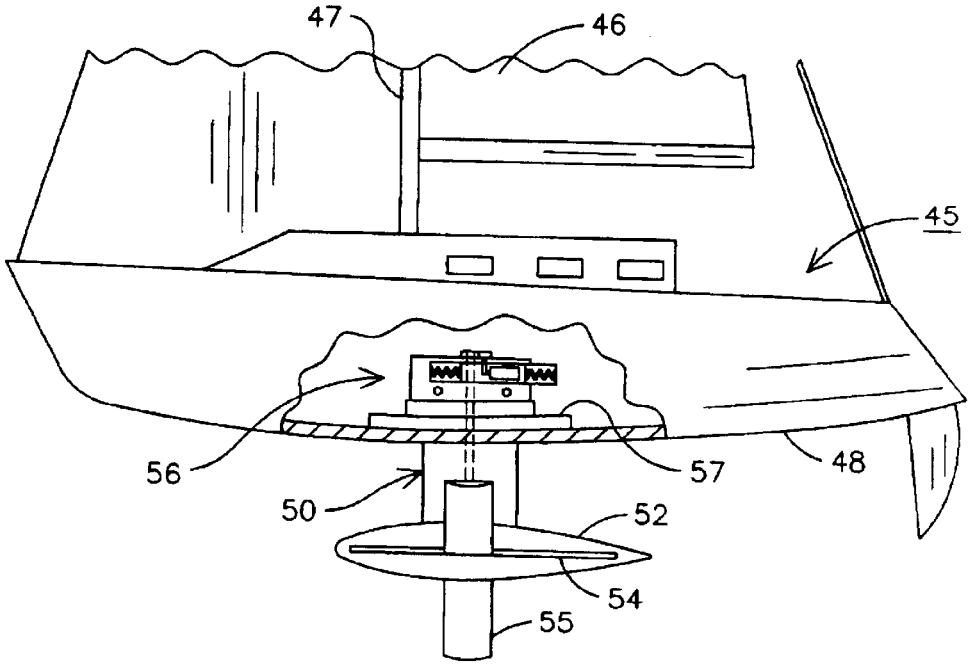
FIG. 9 is a cut away elevation of a sailboat having a canting keel with a pivotal foil in the bulb.
Figure 10:
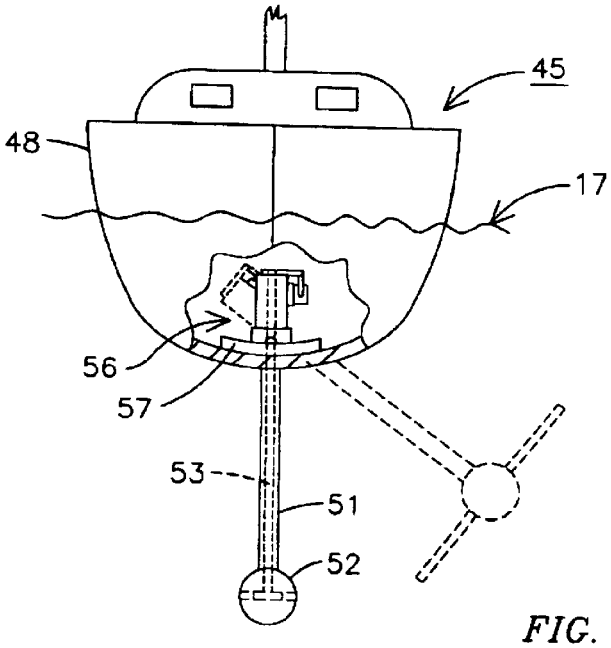
FIG. 10 is a partial cut away of the sailboat of FIG. 9 showing the canted keel with the foils nested and extended.
Figure 11:
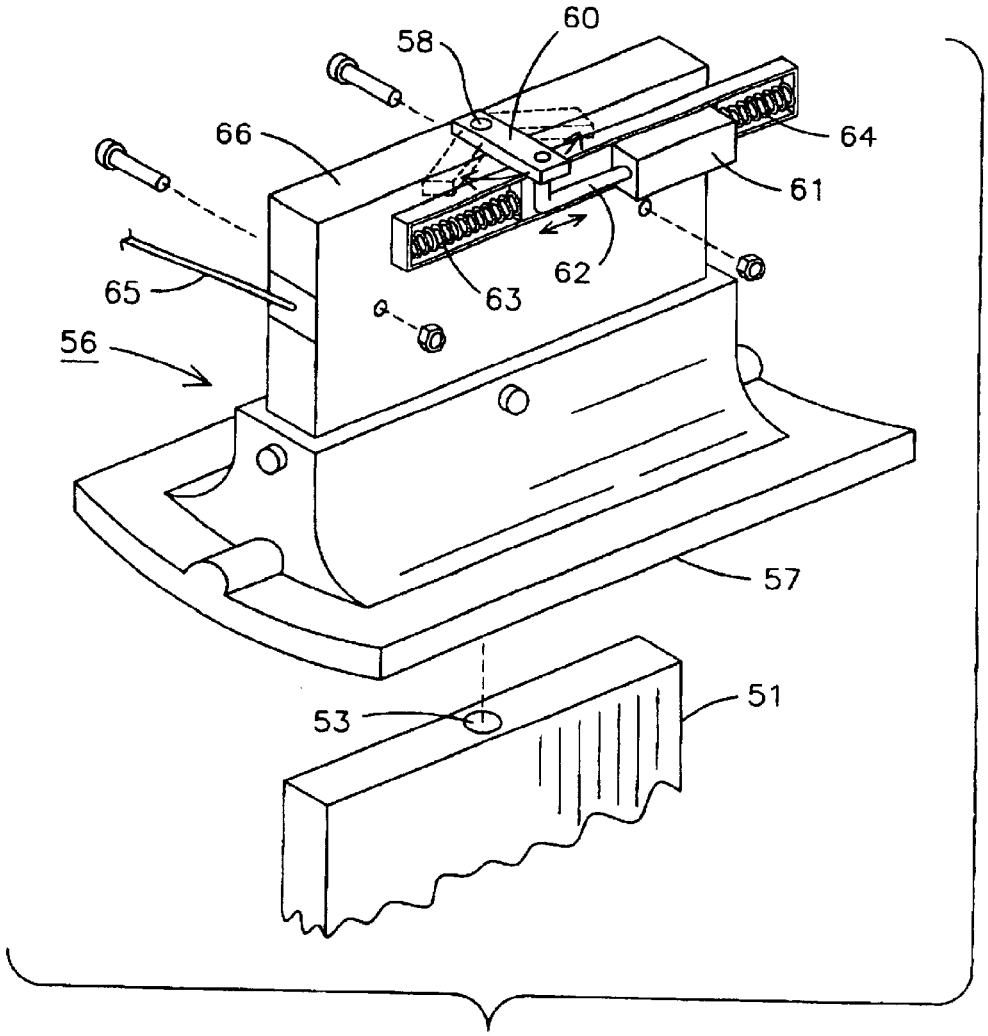
FIG. 11 is a perspective view of the canting keel pivotable foil operating mechanism.

FIGS. 9, 10 and 11 illustrate yet another embodiment of a pivotal deployable bulb mounted foil which advantageously is incorporated into a canting keel. A sailboat 45 has sails 46 attached to a mast 47 and a hull 48. A canting keel 50 system is attached to the bottom of the hull 48 to allow a keel 51 to move from side to side. The keel 51 has a bulb 52 mounted to the bottom thereof and has a channel 53 running therethrough and into the bulb 52. The bulb 52 has an elongated slotted area 54 therein and a pivoting foil 55 mounted in the slot 54 where it is pinned and connected to the shaft 53 for rotation from a nested position within the bulb to an extended operative position.

The keel 51, as shown in FIG. 11, is mounted to a keel canting mechanism 56 having a base plate 57 which mounts to the bottom inside of the hull 48. The keel 51 is mounted therein so as to allow the keel to rotate, as shown in FIG. 10, while the boat is underway. The shaft 58 extends through the keel 51 for operating the foils remotely from within the hull 48. A lever 60 rotates the shaft 58 responsive to a ram 61 which can be a hydraulic ram or can be electric or pneumatic for driving the ram 62 to push the lever 60 back and forth to rotate the shaft 58 to move the foil from a nesting to a operative position. A pair of springs 63 and 64 protect the foils against damage. A hydraulic ram 65 is attached to the keel board attaching portion 66 to push or pull the keel board for canting the keel board as desired.

It should be clear at this time that a pivotally deployable bulb mounted foil for a sailing yacht or the like has been provided which can pivot a foil mounted within a keel bulb remotely as needed to provide lateral resistance for the boat hull in water and which allows the foils to be rotated back into a nested position for greater speed when the foils are not needed for lateral resistance. It should also be clear that the pivotable bulb mounted foil is also contemplated as mounted to a canting keel in which both the canting keel and the foil can be operated remotely from within the hull. However, it should be clear that the present invention is not to be considered as limited to the forms shown which are to be considered illustrative rather than restrictive.

I claim:

1. A sailing boat comprising:

a boat hull, a keel having two sides and extending from said hull, said keel having an elongated ballast bulb thereon;

a rotatable foil attached to said keel bulb and forming an integral part thereof when in a nested position and being rotatable about a generally perpendicular axis to said keel on both sides of said keel into an open operative position;

a control member extending through said hull and keel and being operatively attached to said foil to rotate said foil from the nested position forming part of said bulb to the operative position to provide lateral resistance in the water; whereby a sail boat keel bulb having an extendable foil maintains low resistance in water when said foil is nested into said bulb and provides lateral resistance for the hull in water when said foil is extended into an operative extended position.

2. A sailboat in accordance with claim 1 in which said foil is rotatably mounted to said bulb with a center pin in the middle portion of said foil for rotation from a nested position to an operative position having a portion of said foil extending from both sides of said keel bulb.

3. A sailboat in accordance with claim 2 in which said control member is a shaft extending through a channel in said keel and operatively connected to rotate said foil on said center pin to protrude said foil out of either side of said bulb when said shaft is rotated.

4. A sailboat in accordance with claim 1 in which said foil forms the bottom of said keel bulb.

5. A sailboat in accordance with claim 1 in which said foil forms an elongated section taken from the center portion of keel bulb.

6. A sailboat in accordance with claim 1 in which said keel is a canting keel which can be canted to either side while extending said foil as desired.

7. A sailboat in accordance with claim 3 in which said shaft is hydraulically rotated against a spring bias.

8. A sailboat in accordance with claim 1 having a pair of foils each pinned to said keel bulb and each being rotated from a nested position as part of said bulb to an operative position, one of said pair being rotatable out of each side of said bulb.

9. A sailboat in accordance with claim 8 in which said control member includes a cable extending through a channel in said keel operatively connected to each said foil to rotate each said foil on a center pin to protrude each said foil out of one side of said bulb.

10. A sailboat in accordance with claim 8 in which said control member includes two cables extending through a channel in said keel operatively connected to each said foil to rotate each said foil on a center pin to protrude each said foil out of one side of said bulb.

11. A sailboat in accordance with claim 10 in which each said foil has a spring connected thereto biasing each said foil into a nesting position in said bulb.

* * * * *